US006569026B1

(12) United States Patent
Weis

(10) Patent No.: US 6,569,026 B1
(45) Date of Patent: May 27, 2003

(54) GOLF TRAINING DEVICE

(76) Inventor: Raymond P. Weis, 404 14th St. Southeast, Austin, MN (US) 55912

( * ) Notice: Subject to any disclaimer, the term of this patent is extended or adjusted under 35 U.S.C. 154(b) by 0 days.

(21) Appl. No.: 09/504,549

(22) Filed: Feb. 15, 2000

(51) Int. Cl.[7] ..... A63B 57/00; A63B 69/36
(52) U.S. Cl. ..... 473/139; 473/278
(58) Field of Search ..... 473/139, 150, 473/188, 193, 219, 229, 231, 266, 278, 279; D21/791, 792

(56) References Cited

U.S. PATENT DOCUMENTS 1,191,444 A * 7/1916 Lott ..... 473/139
1,363,446 A * 12/1920 Vogel ..... 473/139
1,753,654 A * 4/1930 Hanson ..... 473/139
1,881,991 A * 10/1932 Yaggi ..... 473/139
1,979,795 A * 11/1934 Clark ..... 473/139
1,980,701 A * 11/1934 Rosengarten ..... 473/278
1,983,671 A * 12/1934 Kohler ..... 404/32
2,124,123 A * 7/1938 Rosengarten ..... 15/208
2,490,409 A * 12/1949 Brown ..... 473/139
3,164,386 A * 1/1965 Fink ..... 473/149
4,946,719 A * 8/1990 Dempsey ..... 428/17
5,028,052 A * 7/1991 Miller ..... 273/DIG. 31
5,451,059 A 9/1995 Weis
5,910,053 A * 6/1999 Scalise ..... 473/257

OTHER PUBLICATIONS

Efunda Engineering Fundamentals (www.efunda.com).*

* cited by examiner

*Primary Examiner*—Paul T. Sewell
*Assistant Examiner*—Alvin A. Hunter, Jr.
(74) *Attorney, Agent, or Firm*—Moore, Hansen & Sumner

(57) ABSTRACT

A golf training device for use with a swinging driver golf club on a golf ball simulating target having a diameter substantially equal to the diameter of a real golf ball and a durable turf simulation apparatus. The target unit comprises a golf ball simulating target disposed on a curved tee attached to a pivotal base. The turf simulation apparatus includes a foundation layer, stiffening layer and upper layer. The foundation layer defines an aperture which surrounds the area around the target unit. The turf simulation apparatus dampens the force of a striking golf club head for reducing damage to the club head and rebounding forces to the golfer's wrists and arms.

2 Claims, 5 Drawing Sheets

GOLF TRAINING DEVICE

This invention relates generally to golf training devices and more particularly to golf training devices simulating the feel of a golf course playing surface and having pivotal directional target unit structures that provide feedback about where generally a golf swing would cause a real golf ball to go, namely to hook, go straight ahead or slice.

BACKGROUND OF THE PRESENT INVENTION

Various golf training devices are known and utilized to improve golfing skills. For example such a golf training device is disclosed in Weis U.S. Pat. No. 5,451,059. The device utilizes in part a golf ball simulating target having a diameter substantially equal to the diameter of a real golf ball and a means for supporting the golf ball simulating target. The target supporting means is mounted to two collar arms and pivots relative to a stake inside a sleeve in the ground. Although, these type of golf training devices function effectively on some surfaces, they have not been found entirely suitable on a variety of surfaces such a turf, dirt, wood, concrete, asphalt and smooth surfaces especially where portability and adaptability is a major requirement. It would be desirable to have a means that would help with the imperfect swings where a club head repeatedly hits the mat with sufficient force to eventually damage the club head or hurt a golfer's shoulder's, arms or wrist. It would also be desirable to provide better feedback about whether the golf swing would cause a real golf ball to hook up straight or slice.

SUMMARY OF THE INVENTION

It, therefore, is an object of this invention to provide an improved golf training device for dampening the force from a club head where imperfect swings repeatedly hit the mat to reduce damage to the club head or injuries to a golfer's shoulder, arm or wrist.

Another object is to provide immediate feedback to the golfer about whether the swing would cause a real golf ball to hook, go straight or slice.

A further object of the invention is the provision of an underlay turf weave to increase the durability of the turf simulation apparatus after many frequent violent strikes by the club head.

The importance of this golf training device is its usefulness to different types of golfers on different types of surfaces and at different locations. The golf training device can be used on different playing surfaces such as over turf, on dirt ground, asphalt, wood floors, decks and concrete. The golf training device can be used as a hitting range, a training device, or a warmup device. The golf training device is designed for a first time golf student, a golfer who wishes to practice over winter to keep up; or a golfer who wishes to develop a hitting straight muscle memory. Another advantage to the golf training device is that it can be used in any place a person can swing a driver, both outdoors and indoors. Even in a low ceiling room, a golfer can still benefit from the training device by practicing half swings.

Still another object is to provide a golfer with a focus point for warming up before playing golf.

A still further object is to exercise a particular golfer's swing starting with a slow motion or gentle swing and working up to the golfer's normal full "swing". This golfing device helps a particular golfer to find the right position for addressing the ball to allow the club head to properly come to and through the ball. The golfer can "curve" or "muscle memory" the golfer's swing according to that golfer's particular body type to improve the golfer's swing.

The foregoing objects of the present invention are provided by an apparatus for improving that golfer's skill at playing golf, namely, a golf training device for use with a golf club comprising a turf simulation apparatus, a foundation layer, a stiffening layer, and an upper layer. The foundation layer defines a chamber. Connected to the turf simulation apparatus is a target unit. The foundation layer may comprise a rubber mat having knobs on the upper surface of the rubber mat and four suction cups on the bottom surface on each corner of the rubber mat. A stiffening layer may be comprised of a polycarbonate resin sheet material. The target unit can preferably pivot for indicating the direction of ball travel and have a base pivotally connected to the stiffening layer. Connected to the base of the target unit is a swing indicator and tee, preferably a curved tee. On the top of the curved tee is a golf ball simulating target. The golf ball simulating target can have a half ball shape. The target unit may have a front face, a side face and another side face. The upper layer of the golf training device includes a turf weave. On the bottom of the turf weave, an underlay may be used to strengthen the durability of the upper layer. Fasteners such as grommets connect the upper layer with the stiffening layer and foundation layer.

The stiffening layer of the golf training device is elastically deformable from an initial first position to a depressed second position extending into the chamber of the foundation layer. When the stiffening layer is urged downwardly and vertically by the violent force of the striking club head into the chamber of the foundation layer, the stiffening layer dissipates some of the energy from the violent force away from rebounding back to the hands, wrists, arms and shoulders of the golfer and thereby helps to protect the golfer from harm.

The foundation layer has an upper surface and a bottom surface. The foundation layer further includes a plurality of knobs spaced apart on the upper surface of the foundation layer. The stiffening layer is elastically deformable from an initial first position to a depressed second position extending between the plurality of spaced apart knobs on the upper surface of the foundation layer. The stiffening layer is urged downwardly by the subtle force of the striking club head into the empty space defined by the foundation layer between the plurality of knobs of the foundation layer. The stiffening layer dissipates some energy of the subtle force away from rebounding back to the hands, wrists, arms and shoulders of the golfer. The invention thereby helps to protect the golfer, to simulate the yielding nature of a well tended golf course, to reduce the incentive for improperly swinging the club to avoid the discomfort of the hit and to promote concentration on properly swinging the club.

BRIEF DESCRIPTION OF THE DRAWINGS

FIG. 6 shows a front top plan view of the position of the target unit of the golf training device and the golf club head shortly after the target unit was struck by the golf club head as viewed by a right-handed golfer.

DETAILED DESCRIPTION OF THE INVENTION

Figure 1:
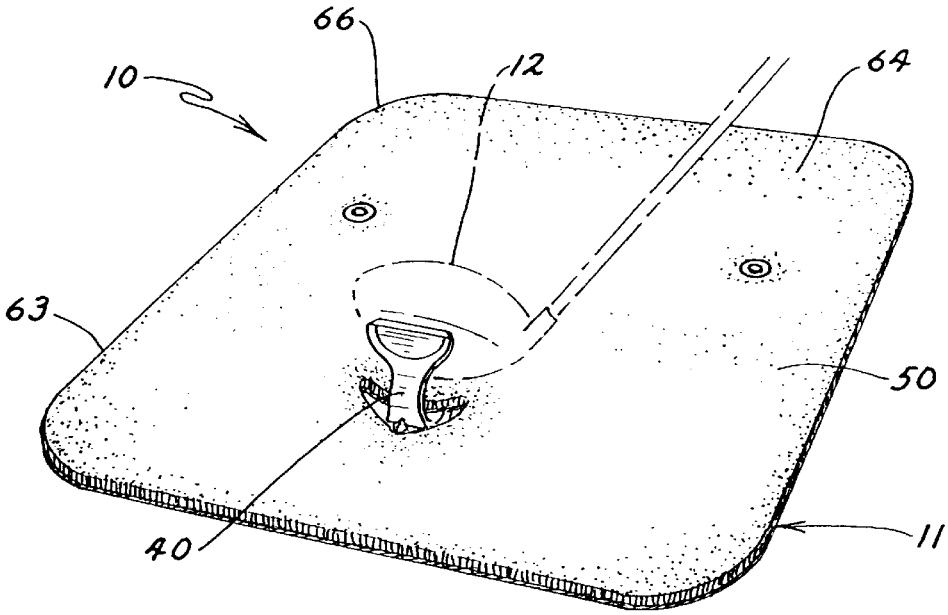
FIG. 1 is a front perspective view of a golf training device embodying the invention and wherein a golf club head is shown in phantom.

A first embodiment of the present invention is illustrated in FIGS. 1 through 7. FIG. 1 shows a perspective view of one embodiment of the present golf training device invention. Referring now to FIG. 1, a golf training device 10 in accord with the present invention includes a turf simulation apparatus 11 and a target unit 40.

The turf simulation apparatus 11 has a foundation layer 20, a stiffening layer 30 and an upper layer 50 which are joined together by a fastener such as two spaced-apart grommets 62. The turf simulation apparatus 11 has a first end 63 to which the target unit 40 is attached and a second end 66 where, optionally, an angled slope 64 may be provided.

Figure 5:
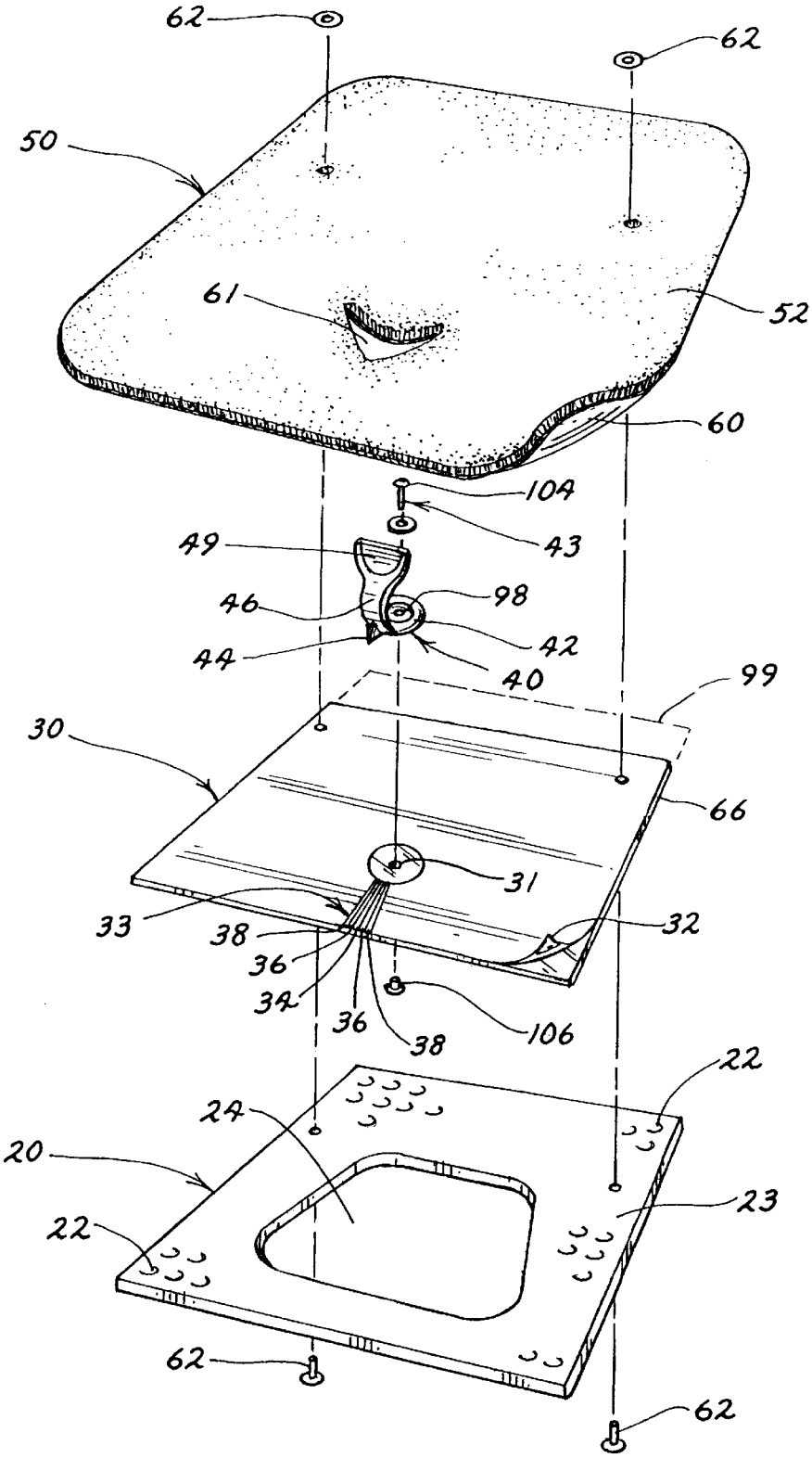
FIG. 5 is an exploded perspective view of the golf training device of FIG. 1 showing the foundation layer, stiffening layer, target unit, and upper layer.

The angled slope 64 is formed by cutting away the rearmost portion of the stiffening layer 30 in the second end 66 of the turf simulation apparatus 11 at the end farthest from the target unit 40 to make a gap 99, which is illustrated in FIG. 5. The gap 99 allows a portion of the upper layer 50 to lean downwardly upon a portion of the foundation layer 20 as a ramp. Thus, the overlying area of the upper layer 50 and the shorter length of the stiffening layer 30 cooperate to create a smooth angled slope 64 on the turf simulation apparatus 11 for accommodating some types of improper swings that would otherwise abruptly catch the violently swinging club head 12 with the second end 66 of the turf simulation apparatus 11.

The foundation layer 20 may be formed from commercially available high friction rubber mat material and is preferably generally rectangular in shape. The foundation layer 20 is preferably formed with a plurality of regularly arranged knobs 22 or protrusions on the upper surface 23 of the foundation layer 20 and a plurality of suction cups (not shown) integrally formed to the bottom surface (not shown) of the foundation layer 20 such as on each corner of the foundation layer 20. The purpose of the foundation layer 20 is to provide a high friction base that helps keep the turf simulation apparatus 11 in place on a playing surface 90 and to provide an impact absorbing medium to reduce and dampen forces from a striking golf club head 12. The effectiveness of the foundation layer 20 is enhanced by utilizing a plurality of suction cups (not shown) on the bottom surface (not shown) of the foundation layer 20. Preferably, the plurality of suction cups each have the shape of a concave disc and are integral with and molded to the foundation layer 20 for securing the turf simulation apparatus 11 to a smooth playing surface 90. The foundation layer 20 preferably has a thickness of between 0.255 inch to 1/32 inch, and more preferably about 0.25 inch.

Over the foundation layer 20 lays a stiffening layer 30. The shape of the stiffening layer 30 is generally rectangular but shorter in length than the foundation layer 20 by a predetermined length, which is illustrated in FIG. 5 as the gap 99. The stiffening layer 30 is formed of a flexible yet tough material. Preferably, the material is transparent to aid with assembly. Important objects of this invention include simulating the feel to a golfer of a club swinging on an actual golf course. If the swinging golf club head 12 is mistakenly aimed too low and impacts the turf simulation apparatus, another object is to simulate the feel and yielding nature of a golf course driving tee or fairway by dampening the rebounding energy from the force of an improperly and violently swinging golf club.

The inventor found it challenging to obtain a suitable stiffening layer material. A stiffening layer 30 constructed of sheet metal was found to bend and dent excessively. A stiffening layer formed of spring steel was found to be undesirable because when the club head 12 hits the stiffening layer 30, rebounding forces are fully transferred back to the golfer and cause too much club bounce. After extensive testing, it has been found that a polycarbonate resin sheet material having a thickness of approximately 1/8 inch and sold under the trademark name of Lexan™ owned by General Electric Company of Schenectady, Mass. 12306 is highly effective as the stiffening layer 30 of the turf simulation apparatus 11. A pivot aperture 31 is formed in the stiffening layer 30 near the first end 63 of the turf simulation apparatus 11 to receive the first bolt 104, which connects the target unit 40 to the turf simulation apparatus 11.

Optionally, a white marking sheet 32 is disposed on the top surface of the stiffening layer 30. A scale 33 is placed over the white marking sheet 32 between the target unit 40 and the closest end of the stiffening layer 30. Radiating out from the target unit 40 from a common starting point at the pivot aperture 31, the scale 33 comprises a straight line 34, a second indicia 36 on either side of the straight line, and a third indicia 38 on either side of the second indicia 36. The second indicia 36 and the third indicia 38 each form an acute angle having one ray in common with the straight line 34. In the preferred embodiment, the scale 33 uses color such as green for the straight ahead line 34, yellow for the second indicia 36 and red for the third indicia 38. Thus the starting point for each ray of the acute angles of the second indicia 36 and the third indicia 38 as well as starting point for the straight line 34 is the same point, namely the pivot aperture 31 defined by the stiffening layer 30.

The upper layer 50 of the turf simulation apparatus 11 is positioned over the stiffening layer 30 and is connected to the stiffening layer 30 and the foundation layer 20 by fasteners such as the grommets 62 shown in FIG. 5. The upper layer 50 includes a turf weave material 52 and optionally an underlay 60. The turf weave 52 of the upper layer 50 is made of synthetic grass fibers and filaments. An example of such a trademarked material is ASTROTURF™ owned by SouthWest Recreational Industries Incorporated at 701 Leander Drive, Leander Tex. 708646. When the upper layer 50 includes an underlay 60, the form of the turf weave material 52 is preferably without any backing to facilitate the application of the underlay 60.

In a preferred embodiment, the turf simulation apparatus 11 is generally rectangular in shape and about 12 inches wide by 16 inches long and ½ inch deep. The upper layer 50 includes a substantially V-shaped aperture 61 for a portion of the target unit 40 that protrudes through the turf weave 52 to allow the target unit 40 to pivot. The V-shaped aperture 61 has two important functions. The V-shaped aperture 61 as shown in FIGS. 1,3,4 and 5 allows the upper layer 50 to cover and protect the base 42 of the target unit 40 from direct contact with an improperly swinging club head 12 that would otherwise strike the front of the base 42 and could rip off the entire target unit 40. In addition, the V-shaped aperture 61 that allows the upper layer 50 to cover the base 42 of the target unit 42 protects the club head 12 from scarring or expensive damage.

It has been found after extensive experimentation that commercially available carpets do not work well enough with the invention to be used as an upper layer 50 because the backing frays too quickly and fails. Even tough indoor-outdoor carpet suffers from the undesirable properties of having its backing fray too quickly. It has also been found that increasing the thickness of the backing to improve the strength of the backing interferes with the successful operation of this invention. Specifically, carpet materials made thick enough to be sufficiently durable were found to be too thick for simulating the golf club feel of a swing at the typical net height of an actual golf ball and tee placed into sod and was thus unsuitable for use on the playing surfaces 90 intended for the purposes of this invention.

Figure 3:
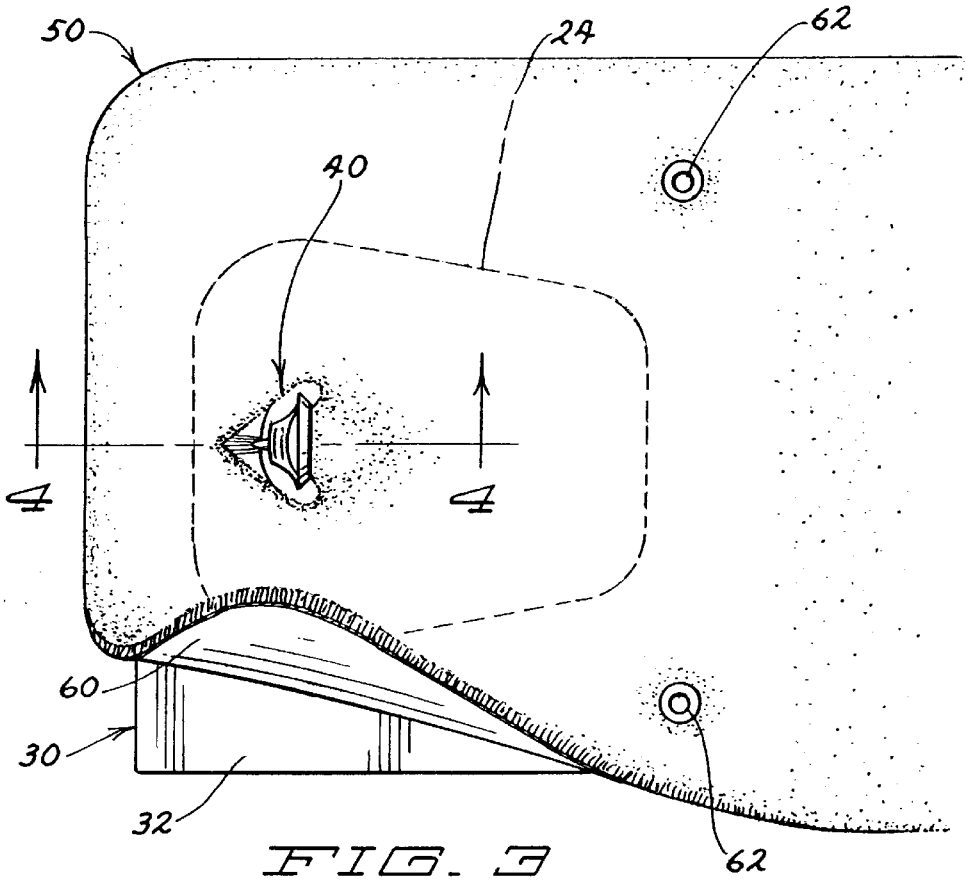
FIG. 3 is a top plan view of the golf training device of FIG. 1 wherein a corner of the turf simulation apparatus has been upturned showing the relative location of the chamber in the foundation layer in phantom and shows a corner of the turf simulation apparatus to expose the interior construction.

In a preferred embodiment shown in FIGS. 3 and 5, an underlay 60 is affixed to the bottom of a turf weave 52 without backing to significantly increase the durability of the upper layer 50. An example of material suitable for use as an underlay is a plastisol type material. A preferred example of the generic plastisol material is the trademarked material Rhinohide™ polyurethane from the Tandem Company of Minneapolis, Minn. that is currently used in long low pig buildings for coating heavy metal wire floors to protect pig feet. The thickness of the dried underlay 60 is 0.5 inch or less. Most preferred is an underlay 60 thickness within a range of about 1/16 inch minimum to 3/32 inch maximum. More than 0.5 inch is undesirable because the underlay 60 becomes too stiff to adequately simulate the feeling of sod on a golf course. Typically, turf weave 52 and underlay 60 together in one embodiment of this invention have a combined height of about $3/8^{th}$ of an inch.

To form the upper layer 50, the starting materials include a container of the liquid underlay 60 and a roll of turf weave 52 without a backing. An example of an underlay 60 material that can be used is a generic plastisol material such as the trademarked material Rhinohide™ polyurethane from the Tandem Company. An example of the typical length of a turf weave 52 roll is approximately 50 feet and a width of 4 feet. The turf weave 52 is unrolled and spread out flat on a working surface. Next, the liquid underlay 60 is poured onto the turf weave 52 and the liquid underlay 60 is spread evenly over the entire underside of the turf weave 52. The liquid underlay 60 is then allowed to dry and adhere to the turf weave 52 so as to make a permanent bond therewith and thus create a stronger backing for the turf weave 52. Finally, the finished combination is cut to appropriate sizes for the upper layer, such as 12 inches wide by 16 inches long.

Another way to add the underlay 60 to the upper layer 50 is by use of any suitable commercial carpet backing device as long as the device has a nonsticking coating over the belt of the backing device such as the nonsticking material sold under the trademark Teflon™.

Adding this stronger underlay 60 to the upper layer 50 assures increased durability of the turf weave 52 against repeated violent club strikes and creates a drainable layer, which is valuable when used outdoors because it allows water to drain from the turf simulation apparatus 11. It was unexpected and surprising to find that the upper layer 50 with its underlay 60 could withstand several thousand more heavy impact strokes from a golf club head 12 before fraying than any commercially available carpet or artificial grass.

A further problem with commercially available ASTROTURF™ type material for the purpose of this invention is that it tends to hold water, is hard to dry out, and cannot be squeeged dry. The problem can become significant at outdoor driving ranges where after a rain, the puddle of water has to be removed from numerous water impermeable mats to make the mats useable again. It has been found ineffective to simply poke holes through the ASTROTURF™ for drainage because the turf then becomes too flexible and has even less durability to accomplish the objects of this invention. A significant advantage with the use of the underlay 60 is the draining feature, which can be incorporated into the upper layer 50.

To establish proper drainage of the upper layer 50, a bed of upright, pointed nails is formed and placed under the turf weave 52 with the nails passing through and impaling the turf weave 52. The liquid underlay 60 is then poured over the turf weave 52 and the nails and allowed to dry. The underlay 60 is then removed from the bed of nails. The dried underlay 60 with the nail perforations both remains strong enough to be used as the upper layer 50 and has the required drainage capability.

Figure 2:
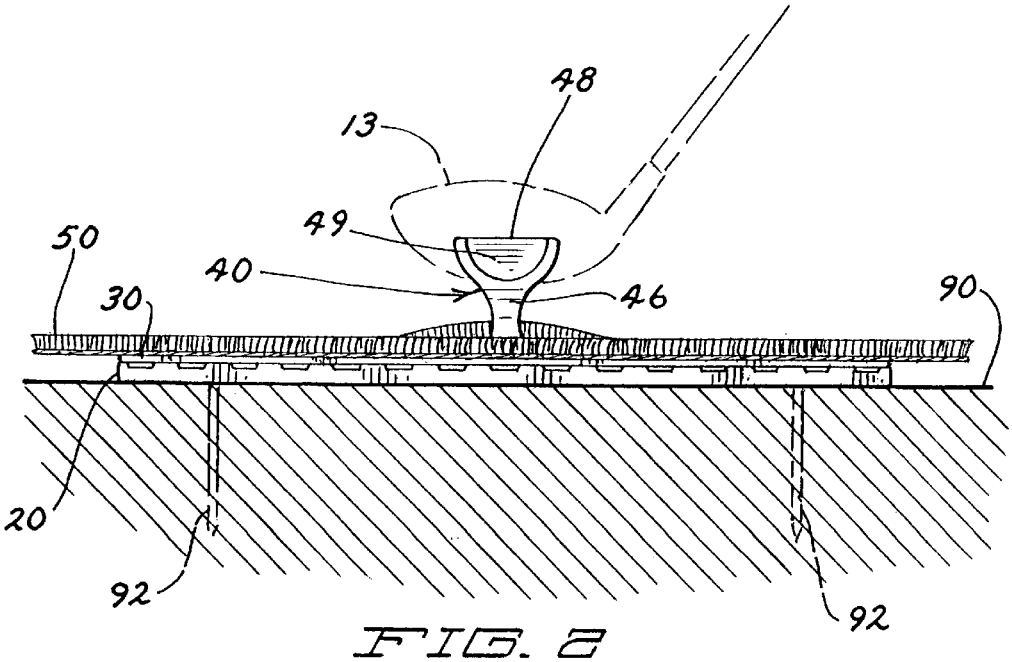
FIG. 2 is a front elevational view of the golf training device of FIG. 1 secured to a supporting surface by two anchors.

Various types of a fastener may be used such as grommets 62, rivets, or appropriate nuts and screws or adhesives. The illustrated grommets 62 are preferred because they serve as an anchor point with the central grommet aperture available to accept the stake, screw or other such anchor 92 to allow attachment to a playing surface 90 as shown in FIG. 5. Preferably, the fastener such as the grommets 62 defines an aperture of sufficient size to allow the anchor 92 to secure the turf simulation apparatus 11 to the playing surface 90 as shown in FIGS. 2 and 3. The type of anchor 92 used depends on the type of playing surface 90. For example, an anchor 92 for use on turf and on soil could be a golf tee or other such stake. Wood screws are another example of an anchor 92 for use on a wood deck type of playing surface 90.

The size of the foundation layer 20, chamber 24, stiffening layer 30, and upper layer 50 varies according to the desired particular use and overall size of the invention. For example, a turf simulation apparatus 11 having an upper layer 50 size of 14 inches×19 inches, a stiffening layer 30 size of 12 inches×12 inches, and the foundation layer 20 size of about 12 inches×16 inches with a chamber 24 about 7 inches×8.5 inches has been found effective.

A target unit 40 is disposed on the first end 63 of the turf simulation apparatus 11 and protrudes through the V-shape aperture 61 defined by the upper layer 50 as shown in FIGS. 1, 3 and 5. Target unit 40 includes a base 42, a swing indicator 44, a tee such as a curved tee 46 and a simulated golf ball 48. The target unit 40 is preferably formed from a shape memory type of material so that when the target unit 40 is struck by the golf club head 12, the target unit 40 will naturally return quickly to its former upright position identity to be struck again. The tee of the target unit 40 must be able to retain memory of rest position of the target unit 40 after repeatedly violent blows from a golf club head 12. The target unit 40 may be made of any material capable of withstanding substantial forces from repeated blows over a wide variety of temperatures. For example, the target unit 40 may be made of a generic plastisol material such as the trademarked material Rhinohide™ polyurethane from the Tandem Company of Minneapolis, Minn. More preferably, the target unit 40 may be made of a polyurethane material having between 100 and 50 durometer stiffness. Most preferably, a polyurethane material having about an 85 durometer stiffness measure (a 100 durometer stiffness measure being unbendable and 80 durometer stiffness being about the stiffness of the wheels on an inline skate) can be used which is available from LTI Flexible Products of Rodgers, Minn. 55374 and has been found to meet the operational requirements of this invention.

The base 42 of the target unit 40 is generally circular in shape. The base 42 includes a recessed aperture 98, shown in FIG. 5, sized to accommodate a washer and a target fastener 43 in the center of the base 42. A preferred embodiment of the target fastener 43 is a first bolt 104 and second bolt 106. The first bolt 104 extends from the top of the base 42 through the washer and the recessed aperture 98 and connects at the bottom of the stiffening layer 30 with the second bolt 106. The head of the second bolt 106 has a diameter substantially similar to the washer and is disposed below the stiffening layer 30. The purpose for recessing the washer and the first bolt 104 below the top surface 42 of the base 42 is to ensure that when the club head 12 swings and hits the base 42 of the target unit 40, the club head 12 does not hit the first bolt 104 or the target fastener 43. The first bolt 104 and the second bolt 106 function together as an axle to allow the target fastener 43 to freely move about the first bolt 104. The base 42 is preferably pivotally attached to the stiffening layer 30 by the target fastener 43.

It has been found helpful to have a swing indicator 44 on the perimeter of the base 42. The swing indicator 44, when used in conjunction of the scale 33 serves as a hook, slice, and straight ahead indicator. The swing indicator 44 extends radially outward from the center of the base 42 and is generally perpendicular to the front face 70 of the golf ball simulating target 48. A front face perpendicular line 72 is defined by being perpendicular to the front face 70 of the golf ball simulating target 48, having a starting point at the center of the base 42, and extending radially outward from the center of the base 42 through the swing indicator 44. The swing indicator 44 with the front face perpendicular line 72 running though the swing indicator 44 is useful for indicating generally in a quick, easy to visualize way the relative degree and direction of the ball flight path created by that particular swing, be it straight ahead, hook, slice, fade or draw. Moreover, the swing indicator 44 when used in combination with the scale 33 and indicia can provide the golfer even more specific information for indicating the degree and direction of the ball flight path created by that particular swing to further refine the swing such as in fade or draw training.

The tee can be a curved tee 46 that has a somewhat C-shape and attaches to the base 42 directly above and centered with the swing indicator 44. The height of the curved tee 46 is substantially similar to the height of an actual tee above the actual turf on which the golfer stands. The width of the curved tee can be several times wider than an actual golf tee. A novel benefit of the curved tee 46 is to significantly increase the durability of the target unit 40 at the attachment point between the base 42 and the curved tee 46. Previously, a L-shaped straight tee would tear off at the right angled connection between the base 42 and the tee much sooner than the curved tee 46 after many violent strokes with the golf club.

A golf ball simulating target 48 is attached to the curved tee 46. The shape of the golf ball simulating target 48 may be disc shaped, a section of a sphere with a diameter substantially equal to a regulation golf ball. If the golfer misses the golf ball simulating target 48 of the target unit 40, then the golfer knows the swing would have produced a whiff on the golf course. The golf ball simulating target 48 shown in FIGS. 1,2, and 4 has a half ball shape 49. If the golfer swings directly over the half ball shape 49 with the club head 12, but fails to make contact, then the golfer knows he had topped the ball, which would constitute an undesirable swing. The golf ball simulating target 48 has a front face 70, a side face 74, and another side face 76. Disposed on either side of the half ball shape 49, both side faces 74 and 76 may be straight or curved.

In operation, FIG. 1 shows the optimum starting alignment of a golf club head 12 for a right-handed golfer. The starting position for the target unit 40 is set in a straight ahead position.

FIG. 2 shows the desired position of the golf club head 12 relative to the golf ball simulating target 48 at mid-swing just before contact with the target unit 40. The club face 13 is parallel to the front face 70 of the golf ball simulating target 48 above the upper layer 50. Two anchors 92 are shown securing the turf simulation apparatus 11 to the playing surface 90.

The FIG. 3 shows an upper layer 50 pulled back to expose the underlay 60 and white marking sheet 32 on the stiffening layer 30. The phantom outline drawn on the upper layer 50 corresponds to the size and shape of the chamber 24 defined in the foundation layer 20. A major benefit to the user of the golf training device 10 is that when a golfer improperly swings such that the club head 12 strikes the turf simulation apparatus 11 in the area shown by the phantom lines around the target unit 40, a violent striking force will be dampened, thereby reducing potential damage to the club head 12 and dampening the rebounding force from the club to the golfer's hands, wrists, arms and shoulders.

Figure 4:
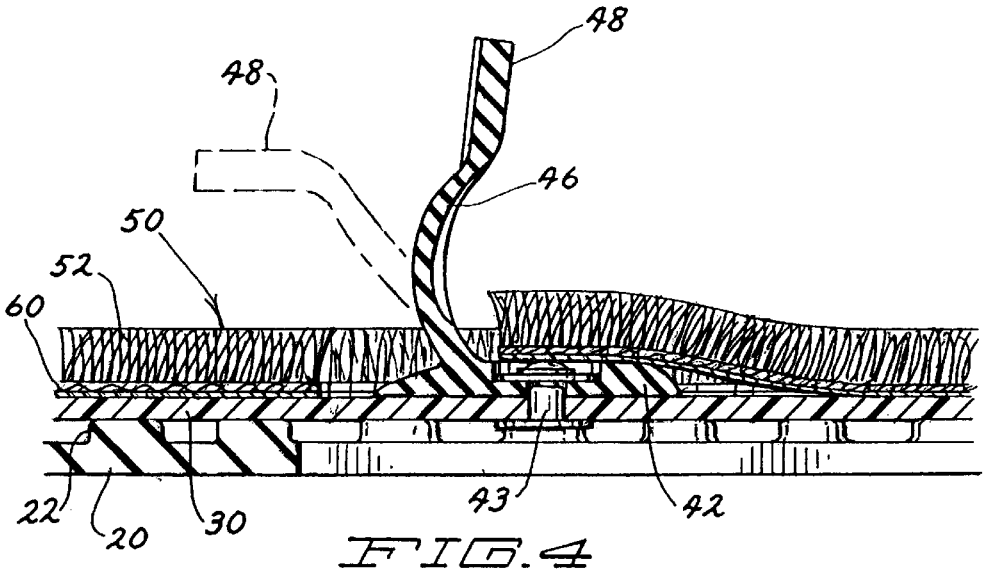
FIG. 4 is a cross sectional side elevational view of the golf training device of FIG. 1 taken in the direction of cutting plane 44 of FIG. 3 and showing alternative positions of the golf ball simulating target of the target unit.

FIG. 4 shows the relative positions of the golf ball simulating target 48 and the curved tee 46 with the solid lines showing their at rest initial position and at rest final position, before and after being struck by the golf club head 12. Additionally, the phantom lines show the deformed intervening relative position of the golf ball simulating target 48 and the curved tee 46 immediately after being struck by the golf club head 12 between the at rest initial position and at rest final position. FIG. 4 also shows how the target fastener 43 is sunk into the recessed aperture 98 of the base 42 below the top surface of the base 42 so that a striking club head 12 does not catch the top portion of the target fastener 43. The circular shape of the target fastener 43 permits the pivoting of target unit 40 to show the angle of attack of the club face 13 at the point of contact with the target unit 40. Above the playing surface 90 is the foundation layer 20 with a plurality of knobs 22 on the top surface of the foundation layer 20. The stiffening layer lies over and contacts the knobs 22. Finally, an underlay 60 lies over that stiffening layer 30. FIG. 4 also shows the underlay 60 and the turf weave 52 of the upper layer 50.

FIG. 5 shows an exploded view the golf training device 10 with the foundation layer 20, the stiffening layer 30, a target unit 40 and a upper layer 50. FIG. 5 also shows the base 42 of the target unit 40 that connects to the stiffening layer 30. The scale 33 is drawn over the white marking sheet 32 that is attached over the stiffening layer 30. Each of one of the narrow ends of the upper layer 50, the stiffening layer 30, and the foundation layer 20 that lays near the target unit 40 all align near each other. The longitudinal length of the upper layer 50 and the foundation layer 20 are similar to each other and extend beyond the much shorter longitudinal length of the stiffening layer 30. The difference in longitudinal length between the stiffening layer 30 and the top 50 and the foundation layer 20 is shown as the gap 99 and creates an angled slope 64 in the area of the second end of the turf simulation apparatus 11 for reducing the chances of an improperly swung club head 12 from catching the turf simulation apparatus 11 before striking the target unit 40.

Figure 6B:
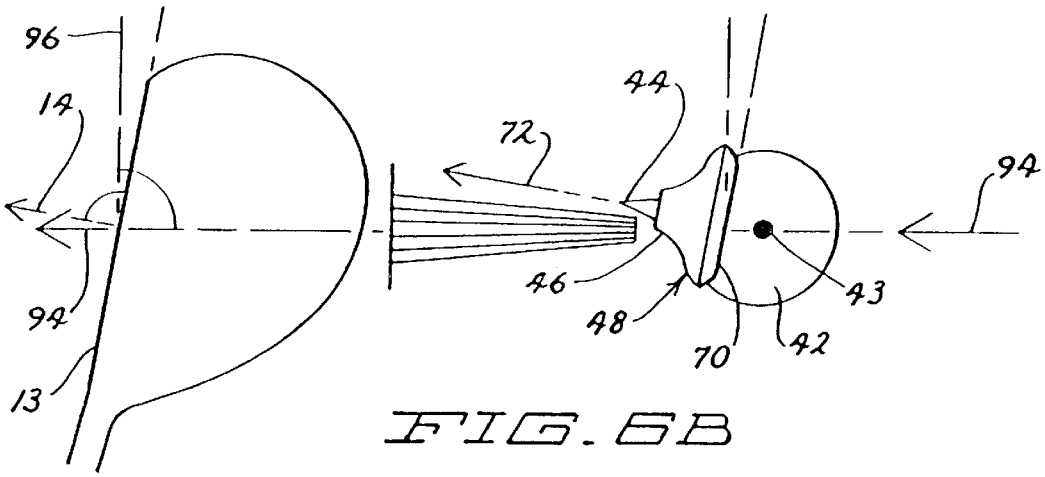
FIG. 6B is a view of the target unit area of the golf training device and illustrating operation during an improper slice type of club swing by a right-handed golfer.
Figure 6A:
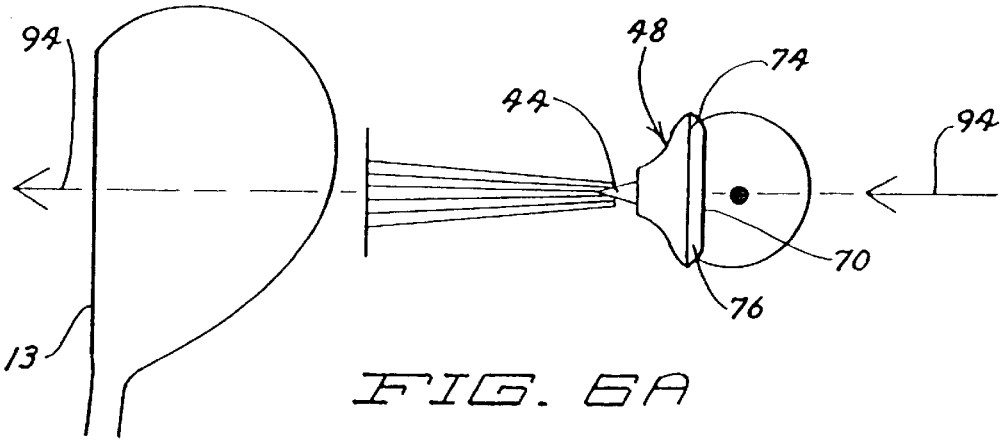
FIG. 6A is an enlarged view of the target unit area of the golf training device and golf club head illustrating operation during a proper straight type of club swing by a right-handed golfer.
Figure 6C:
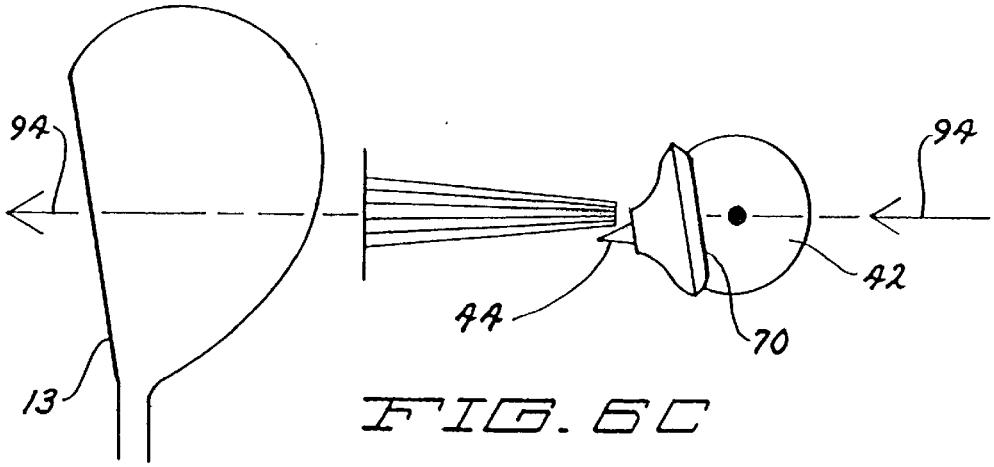
FIG. 6C is a view of the target unit area of the golf training device and illustrating operation during an improper hook type of club swing by a right-handed golfer.

FIGS. 6A, 6B and 6C show three different golf swings following the exact same club swing direction of travel 94. Before each swing, the swing indicator 44 of the target unit 40 is reset into a straight ahead position. Each figure shows the relative position of the target unit 40 and the golf club head 12 shortly after the golf club head 12 strikes the golf ball simulating target 48. In use, the post impact position of the swing indicator 44 remains unchanged until the user manually resets the swing indicator 44 back to the straight ahead starting portion. FIGS. 6A, 6B and 6C all assume the golfer is a right-handed golfer standing in the same position for each swing. Also, FIGS. 6A, 6B and 6C all assume and depict in the figures that the golfer's swing follows same for each swing.

FIG. 6A shows a target unit 40 indicating a normal and correct straight ahead swing. The club face 13 defines a line 96 that is perpendicular relative to the club swing direction of travel 94 of the swinging club. Similarly, the front face 70 of the target unit 40 defines an angle with a line at 90 degrees relative to the club swing direction of travel 94 of the swinging club. In a normal and correct straight ahead swing, the swing indicator 44 coincides with the club swing direction of travel 94 here so the front face perpendicular line 72 coincides with the club head perpendicular line 14 and does not create any angle relative to the club swing direction of travel 94 of the swinging club.

FIG. 6B shows a slice for a right-handed golfer that curves significantly to the right. Both the club face 13 and the front face 70 each define a line that creates an acute angle relative to the direction of travel 94 of the swinging club. Consequently, the same corresponding angles are created by the angle created by the club head perpendicular line 14 relative to the club swing direction of travel 94 and the angle created by the front face perpendicular line 72 relative to the club swing direction of travel 94. In other words, each of those four angles comprise a first line defined by either the club face 13, the front face 70, the club head perpendicular line 14 or the front face perpendicular line 72 and a second line that is relative to and shares the same coincident line as the line defined by the club swing direction of travel 94.

FIG. 6C shows a hook for a right-handed golfer where the ball flight curves significantly to the left. The club face 13 defines a line that makes an obtuse angle relative to the club swing direction of travel 94.

The golf training device 10 provides the benefit of being useable in a variety of predetermined locations, indoors or outdoors, on level or sloped surfaces. In addition, the playing surface 90 on which the golf training device 10 is used may be bumpy and irregular or flat. The turf simulation apparatus 11 may be left unsecured or made secured to a variety of different surfaces such as onto dirt ground, turf, asphalt, wood floor, decks and concrete. To secure the turf simulation apparatus 11 to a wooden deck, wood screws may be inserted through the grommet 62. Typically, golf tees could be inserted through the grommet 62 to secure the turf simulation apparatus 11 onto turf or dirt. On smooth indoor floors, the rubber mat material on the foundation layer 20 and a plurality of suction cups (not shown) on the bottom surface of the foundation layer 20 help to secure the turf simulation apparatus 11 where desired on the smooth floor.

A golfer addresses the golf training device 10 in front of him by orientating his stance and golf club relative to the target unit 40 in the same way as a golfer normally addresses an actual teed up golf ball. A golfer may use a driver or 2-wood and may take a full back swing while aiming for the half ball shape 49 of the target unit 40.

Target unit 40 is initially set in a straight ahead position as shown in FIG. 6*a* with the front face 70 of the golf ball simulating target 48 parallel with the short ends of the turf simulation apparatus 11. The swing indicator 44, which is initially set in a straight ahead position, is disposed over and pointing along a straight ahead line 34 on the scale 33. The golfer then takes a full swing at the target unit 40 with a full follow through.

In the situation where a right-handed golfer is about to make a swing that will produce a slice as shown in FIG. 6B, the first point of contact between the club face 13 of the club head 12 and the golf ball simulating target 48 will be near the heel of the club face 13 against the left side (the lower portion of front face 70 shown in FIG. 6*b*) of the golf ball simulating target 48 on the front face 70 or the left outer side face 76. The heel of the club head 12 is the end of the club head 12 closest to the shaft of the club and the toe of the club head 12 is the end of the club head 12 farthest from the shaft of the club. That single point of contact will cause the target unit 40 to pivot about a target fastener 43. The target unit 40 continues pivoting until a second point of contact from near the toe of the club face 13 with the front face 70 stops the pivoting of target unit 40. In other words, the golf ball simulating target 48 stops pivoting to the right clockwise when the club face 13 contacts the right side of the front face 70 of the golf ball simulating target 48 and stops the pivoting. Consequently, the post impact position of the golf ball simulating target 48 has turned clockwise (to the right) from the starting position thereby indicating a slice. The front face perpendicular line 72 indicated by the post impact position of the golf ball simulating target 48 and the swing indicator 44 show how much of a slice occurred where the larger the angle, the larger the slice.

Thus, if the target unit 40 turns to the left (counterclockwise) after a stroke, the golfer has hooked the ball. If the target unit 40 remains straight after impact, the golfer has driven the ball straight down the fairway. If the target unit 40 was missed on either side of the ball, the golfer has whiffed. A miss above the half ball shape 49 indicates that the golfer has topped the ball.

Figure 7:
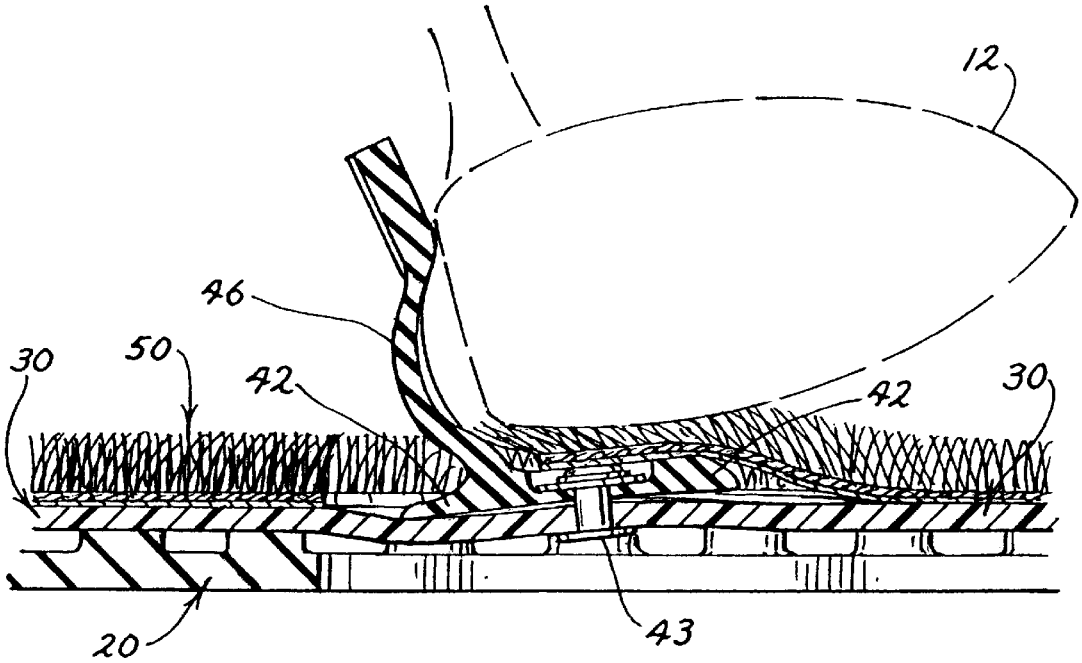
FIG. 7 is an exaggerated symbolic representation in a left elevational view of the position of the target unit and the golf club head while the target unit is improperly struck downwardly by the golf club head near the intersection of the tee and the base of the target unit as viewed by a right-handed golfer for illustrating another advantage of the invention.

An improper golf swing resembling a violent, shallow, downward karate chop near the intersection of the tee 46 and the base 42 of the target unit 40 is one illustration of how in the golf training device 10 helps a golfer. The golf training device 10 has an interconnected foundation layer 20, stiffening layer 30 and upper layer 50 cooperate to receive and to absorb the blow of the club head 12 when the club head 12 improperly strikes the golf training device 10. Consequently, the golf training device 10 helps to prevent injury to the golfer and damage to the golf club while closely simulating the feel of a golf club striking the turf on a natural fairway to enhance the training of the golfer. FIG. 7 illustrates a left elevational view of the position of the target unit 40 and the golf club head 12 while the target unit 40 is improperly struck downwardly by the golf club head 12 near the intersection of the curved tee 46 and the base 42 of the target unit 40 as viewed by a right-handed golfer. In particular, FIG. 7 shows that the stiffening layer 30 is elastically deformable from an initial first position to a depressed second position extending into the chamber 24 of the foundation layer 20. The stiffening layer 30 is urged downwardly at the front end of the base 42 and vertically at the target fastener 43 with the rear end of the base 42 partially raised from the stiffening layer 30 by the violent force of the striking club head 12 into the chamber 24 of the foundation layer 20. The stiffening layer 30 dissipates, neutralizes or diverts some of the energy from the violent force away from rebounding back to the hands, wrists, arms and shoulders of the golfer and thereby helps to protect the golfer from harm.

Additionally, an improper golf swing striking the turf simulation apparatus 11 illustrates how in the golf training device 10 the interconnected foundation layer 20, stiffening layer 30 and upper layer 50 cooperate to dissipate some energy from the subtle force of the striking golf club head 12 away from rebounding back to the golfer. The foundation layer 20 has an upper surface 23 and a bottom surface (not shown). The foundation layer 20 further comprises a plurality of knobs 22 spaced apart on the upper surface 23 of the foundation layer 20. The stiffening layer 30 is elastically deformable from an initial, at rest first position to an intermediate, depressed second position extending between the plurality of spaced apart knobs 22 on the upper surface 23 of the foundation layer 20 such that when the stiffening layer 30 is urged downwardly by the subtle force of the striking club head 12 into the empty space defined by the foundation layer 20, the stiffening layer 30 and the plurality of knobs 22 of the foundation layer 20, the stiffening layer 30 dissipates, diverts or neutralizes some energy of the subtle force away from rebounding back to the hands, wrists, arms and shoulders of the golfer and thereby helps to protect the golfer, to simulate the yielding nature of a well tended golf course, to reduce the incentive for improperly swinging the club to avoid the discomfort of the hit and to promote concentration on properly swinging the club.

The previously described embodiment of the present invention has many advantages, including giving the golfer a focus point for warming up before playing golf. The invention also helps to exercise a golfer's swing, starting with a slow motion or gentle swing and working up to a normal full swing. The golfer can use the invention for finding the correct position for that particular golfer to address the ball and to allow the club head 12 to properly come through the ball. Additionally, the golf training device 10 helps a golfer to find his perfect swing according to the golfer's own particular body size and dimensions and to groove or "muscle memory" the golfer's swing.

While the present invention has been disclosed in connection with the preferred embodiment thereof it should be understood that there may be other embodiments which fall within the spirit and scope of the invention as defined by the following claims:

What is claimed:

1. A golf training device closely simulating the feel of a natural fairway and usable by a golfer on a playing surface for improving the swinging of a golf club having a golf club head that may produce a subtle force or a violent force, comprising:

a turf simulation apparatus, said apparatus including:

a foundation layer positionable on and attachable to the playing surface and formed from flexible, resilient, impact absorbing matting, said foundation layer including a chamber;

a stiffening layer of hard, substantially elastically deformable material, said stiffening layer overlying and contacting said foundation layer;

an upper shock absorbing and decorative layer overlying and contacting said stiffening layer, said upper layer including a grass texture simulating carpet and a shock absorbing material integrally joined to said carpet to receive and endure extensively repeated heavy impact blows from the club head without ripping and tearing of said upper layer;

a fastener interconnecting said foundation layer, said stiffening layer and said upper layer; and a target unit mounted to and extending upwardly from said turf simulation apparatus and including a golf ball simulating target strikeable by a golf club swung by the golfer, said target unit including a base, a tee, and a golf ball simulating target; said tee having two ends, one end connected to said golf ball simulating target and the other end connected to said base, said base of said target unit being pivotally connected to said turf simulation apparatus for indicating the direction of a ball flight path and for hook and slice training, and the other end of said tee connected to said target unit intersecting with said base of said target unit at an angle of greater than 90 degrees relative to said base of said target unit for diverting a point of bending stress on said tee from the force of the club head away from the intersection between said tee and said base to further up said tee to prolong the wear life of said target unit;

said interconnected foundation layer, stiffening layer and upper layer cooperating to receive and absorb the blow of the club head when the head inadvertently strikes said apparatus to thereby prevent injury to the golfer and damage to the golf club while closely simulating the feel of a golf club striking the turf on a natural fairway so as to enhance the training of the golfer.

2. A golf training device closely simulating the feel of a natural fairway and usable by a golfer on a playing surface for improving the swinging of a golf club having a golf club head that may produce a subtle force or a violent force, comprising:

a turf simulation apparatus, said apparatus including:

a foundation layer positionable on and attachable to the playing surface and formed from flexible, resilient, impact absorbing matting, said foundation layer including a chamber;

a stiffening layer of hard, substantially elastically deformable material, said stiffening layer overlying and contacting said foundation layer;

an upper shock absorbing and decorative layer overlying and contacting said stiffening layer, said upper layer including a grass texture simulating carpet and a shock absorbing material integrally joined to said carpet to receive and endure extensively repeated heavy impact blows from the club head without ripping and tearing of said upper layer;

a target unit mounted to and extending upwardly from said turf simulation apparatus and including a golf ball simulating target strikeable by a golf club swung by the golfer, said target unit including a base, a tee, and a golf ball simulating target, said tee having two ends, one end connected to said golf ball simulating target and the other end connected to said base, said base of said target unit being pivotally connected to said turf simulation apparatus for indicating the direction of a ball flight path and for hook and slice training, the other end of said tee connected to said target unit intersecting with said base of said target unit at an angle of greater than 90 degrees relative to said base of said target unit for diverting a point of bending stress on said tee from the force of the club head away from the intersection between said tee and said base to further up said tee to prolong the wear life of said target unit; and a fastener interconnecting said foundation layer, said stiffening layer and said upper layer;

said interconnected foundation layer, stiffening layer and upper layer cooperating to receive and absorb the blow of the club head when the head inadvertently strikes said apparatus to thereby prevent injury to the golfer and damage to the golf club while closely simulating the feel of a golf club striking the turf on a natural fairway so as to enhance the training of the golfer.

* * * * *